US009841181B2

(12) United States Patent
Yang et al.

(10) Patent No.: US 9,841,181 B2
(45) **Date of Patent: *Dec. 12, 2017**

(54) CEILING MOUNTED VENTILATION FAN WITH ILLUMINATION

(71) Applicants: PANASONIC ECOLOGY SYSTEMS GUANGDONG CO., LTD., Foshan, Guangdong (CN); PANASONIC CORPORATION, Osaka (JP)

(72) Inventors: Decong Yang, Foshan (CN); Qianhao Tan, Foshan (CN); Pingting Yang, Foshan (CN); Qiuqian Liang, Foshan (CN); Yannong Wu, Foshan (CN); Hitoshi Yoshikawa, Gifu (JP)

(73) Assignees: PANASONIC ECOLOGY SYSTEMS GUANGDONG CO., LTD., Guangdong (CN); PANASONIC CORPORATION, Osaka (JP)

( * ) Notice: Subject to any disclaimer, the term of this patent is extended or adjusted under 35 U.S.C. 154(b) by 412 days.

This patent is subject to a terminal disclaimer.

(21) Appl. No.: 14/589,084

(22) Filed: Jan. 5, 2015

(65) Prior Publication Data

US 2015/0110626 A1 Apr. 23, 2015

Related U.S. Application Data

(63) Continuation of application No. 14/146,211, filed on Jan. 2, 2014, now Pat. No. 8,956,113, which is a (Continued)

(30) Foreign Application Priority Data

Jan. 6, 2011 (CN) ..... 2011 1 0037124

(51) Int. Cl.
*F21V 33/00* (2006.01)
*F24F 7/06* (2006.01)
(Continued)

(52) U.S. Cl.
CPC ..... *F21V 33/0096* (2013.01); *F04D 29/00* (2013.01); *F04D 29/661* (2013.01);
(Continued)

(58) Field of Classification Search
CPC ..... F21V 33/0096; F04D 29/00; F24F 13/078
See application file for complete search history.

(56) References Cited

U.S. PATENT DOCUMENTS 1,722,825 A 7/1929 Roethel
2,189,008 A 2/1940 Kurth
(Continued)

FOREIGN PATENT DOCUMENTS

CN 101307770 11/2008
CN 101334204 12/2008
(Continued)

OTHER PUBLICATIONS

Office Action issued in Counterpart U.S. Appl. No. 13/982,915, dated Mar. 16, 2016.
(Continued)

*Primary Examiner* — Gregory Anderson
*Assistant Examiner* — Juan G Flores
(74) *Attorney, Agent, or Firm* — Greenblum & Bernstein, P.L.C.

(57) ABSTRACT

A ventilation fan with illumination includes a housing, a fan, and lighting equipment in the housing. The housing includes a first opening communicating with an air outlet, the first opening communicating with a duct, and a second opening that communicates with an interior space, The lighting equipment includes a light, a cover in the housing that surrounds the light periphery, the cover reflecting light and transmitting the light into the space through the second opening, and a restrictor that restricts passage of air between the light periphery and the lighting cover. An air intake gap
(Continued)

is provided between a lower end of the cover and an edge of the second opening and introduced through the second opening and the air intake gap, is discharged through the first opening into the duct, the edge of the second opening being located below the lower end of the cover.

19 Claims, 11 Drawing Sheets

Related U.S. Application Data continuation of application No. 13/992,881, filed as application No. PCT/CN2011/080333 on Sep. 29, 2011, now Pat. No. 8,814,513.

(51) Int. Cl.

| | |
|---|---|
| ***F24F 13/078*** | (2006.01) |
| ***F21V 21/04*** | (2006.01) |
| ***F04D 29/00*** | (2006.01) |
| ***F04D 29/66*** | (2006.01) |

(52) U.S. Cl.

CPC ..... *F21V 21/04* (2013.01); *F24F 7/065* (2013.01); *F24F 13/078* (2013.01); *F24F 2221/14* (2013.01)

(56) References Cited

U.S. PATENT DOCUMENTS

| | | | | |
|---|---|---|---|---|
| 2,689,906 | A | 9/1954 | Corbett | |
| 2,870,319 | A | 1/1959 | Ford | |
| 3,068,341 | A | 12/1962 | Ortiz et al. | |
| 3,744,396 | A | 7/1973 | Raider | |
| 3,785,271 | A | 1/1974 | Joy | |
| 4,142,227 | A | 2/1979 | Aikens | |
| 4,681,024 | A | 7/1987 | Ivey | |
| 5,934,783 | A | 8/1999 | Yoshikawa | |
| 7,175,309 | B2 | 2/2007 | Craw et al. | |
| 7,203,416 | B2 | 4/2007 | Craw et al. | |
| 7,455,432 | B2 | 11/2008 | Craw et al. | |
| 8,434,916 | B2 | 5/2013 | Craw et al. | |
| 8,814,513 | B2 * | 8/2014 | Yang | F24F 7/065 415/213.1 |
| 8,956,113 | B2 * | 2/2015 | Yang | F24F 7/065 415/213.1 |
| 9,103,104 | B1 | 8/2015 | Tom | |
| 2005/0117341 | A1 | 6/2005 | Craw et al. | |
| 2009/0073702 | A1 | 3/2009 | Craw et al. | |
| 2010/0009621 | A1 | 1/2010 | Hsieh | |
| 2013/0266443 | A1 | 10/2013 | Yang et al. | |

FOREIGN PATENT DOCUMENTS

| | | |
|---|---|---|
| CN | 201173477 | 12/2008 |
| CN | 101737763 | 6/2010 |
| FR | 2887018 | 12/2006 |
| JP | 57-68426 | 4/1982 |
| JP | 2-275235 | 11/1990 |
| JP | 4-61235 | 5/1992 |
| JP | 5-118606 | 5/1993 |
| JP | 2006-258363 | 9/2006 |

OTHER PUBLICATIONS

NuTone (QT-9093 Series—Mar. 2004).
NuTone (QT-200 Series—Mar. 2004).
Japan Office action, dated Dec. 18, 2012 along with an english translation thereof.
International Search Report, dated Dec. 22, 2011 in PCT/CN2011/080333.
International Search Report, dated Nov. 8, 2012 in PCT/CN2012/072911.
U.S. Appl. No. 13/982,915 (Yang et al.), filed Jul. 31, 2013.
U.S. Appl. No. 13/626,268 (Yang et al.), filed Sep. 25, 2012.
Office Action dated Jan. 3, 2014 in U.S. Appl. No. 13/992,881.
Japanese Office Action dated May 28, 2013 and an English language translation thereof.
Chinese Office Action, dated May 4, 2014, in corresponding Chinese Patent Application No. 201180062492.1, along with an English translation thereof.

* cited by examiner

CEILING MOUNTED VENTILATION FAN WITH ILLUMINATION

CROSS-REFERENCE TO RELATED APPLICATIONS

The present application is a continuation application of pending U.S. application Ser. No. 14/146,211, filed Jan. 2, 2014, which is a continuation application of U.S. application Ser. No. 13/992,881, filed Jun. 10, 2013 (now U.S. Pat. No. 8,814,513), which is a National Stage of International Patent Application No. PCT/CN2011/080333, filed Sep. 29, 2011, which claims priority to Chinese Application No. CN 2011-10037124.3, filed on Jan. 6, 2011, the disclosures of which are expressly incorporated by reference in their entireties.

TECHNICAL FIELD

The present invention relates to a ventilation fan for push-pull ventilation systems (i.e., a ventilation fan for air supply and exhaust systems) and, more particularly, to a noise reduction structure of ceiling mounted ventilation fans with illumination for push-pull ventilation systems.

BACKGROUND ART

As such a type of ceiling mounted ventilation structure with illumination, there has conventionally been known a structure using a downlight as an example. An example of the conventional ceiling mounted ventilation structure with illumination is shown in FIG. 7 (see, e.g., Patent Document 1).

As shown in FIG. 7, a conventional ceiling mounted ventilation structure 108 with illumination is so made up that a recess portion (dent portion) 102 is provided in a ceiling 101, an electric bulb 105 enclosed by a moisture-proof cover 104 is set in the recess portion 102 via a rubber packing 103, and that a ventilating opening 106 is formed at part of a peripheral wall of the recess portion 102, where a duct 107 is connected at the ventilating opening 106.

By the ceiling mounted ventilation structure 108 with illumination as shown above, the function of indoor ventilation can be fulfilled while a function as a downlight is fulfilled.

PATENT DOCUMENT

Patent Document 1: JP S57-68426 U

SUMMARY OF INVENTION

Technical Problem

In the conventional ceiling mounted ventilation structure 108 with illumination, with the recess portion 102 formed in shape of a circular truncated conical cylinder, an inner wall surface of the recess portion 102 is used as a reflecting surface so that light derived from the electric bulb 105 is reflected by the inner wall surface of the recess portion 102 downward, i.e., toward the room inside. With such an: arrangement adopted, the function as a downlight can be enhanced in the ceiling mounted ventilation structure 108 with illumination.

However, because of the recess portion 102 being formed in shape of a circular truncated conical cylinder, this shape acts as a so-called megaphone, causing an issue that air flow sounds or operating sounds of the fan or the like generated in the ceiling mounted ventilation structure 108 with illumination are increased in directivity in their conduction into the room inside or that such sounds are conducted farther.

Accordingly, an object of the present invention, lying in solving the above-described issues, is to provide a ceiling mounted ventilation fan with illumination capable of suppressing noise conducted to room inside.

Solution to Problem

In order to achieve the object, the invention is configured as follows.

According to a first aspect of the present invention, there is provided a ceiling mounted ventilation fan with illumination comprising: a main housing, and a fan unit and lighting equipment installed in the main housing, wherein the main housing includes a first opening connected to an air outlet of the fan unit, the first opening communicating with a duct, and a second opening formed in a lower part of the main housing so as to communicate with inside of a room, the lighting equipment includes a lighting part, a lighting cover placed within the main housing so as to surround a periphery of the lighting part, the lighting cover having a reflecting surface for reflecting light from the lighting part to lead the light into the room through the second opening, and a restriction member for restricting passage of air through between the periphery of the lighting part and the lighting cover, and a gap for air intake is formed between a lower end of the lighting cover and an edge of the second opening so that air introduced into the main housing through the second opening and the gap for air intake is discharged through the first opening into the duct by the fan unit.

According to a second aspect of the present invention, there is provided a ceiling mounted ventilation fan with illumination according to the first aspect, the lighting equipment comprises an adjustment mechanism for adjusting a height position of the lighting cover relative to the second opening of the main housing, wherein the height position of the lighting cover is adjusted by use of the adjustment mechanism thereby adjusting size of the gap for air intake.

According to a third aspect of the present invention, there is provided a ceiling mounted ventilation fan with illumination according to the first aspect, wherein the lighting cover is formed in such a cylindrical shape as to cover an entire side periphery of the lighting part while the lower end of the lighting cover is formed larger than an upper end thereof, and the restriction member is placed so as to substantially seal at least either one of the upper end and the lower end of the lighting cover.

According to a fourth aspect of the present invention, there is provided a ceiling mounted ventilation fan with illumination according to the third aspect, wherein the lighting cover is formed in such a generally circular truncated conical cylinder shape or polygonal truncated prismoidal cylinder shape that an opening of the lower end is larger than that of the upper end, and a lid member for substantially sealing the opening of the lower end is installed as the restriction member.

According to a fifth aspect of the present invention, there is provided a ceiling mounted ventilation fan with illumination according to the fourth aspect, wherein the lid member is detachably provided at the lower end of the lighting cover.

According to a sixth aspect of the present invention, there is provided a ceiling mounted ventilation fan with illumination according to any one of the first to fifth aspects, wherein a brim is formed so as to protrude from a periphery of the lower end of the lighting cover.

According to a seventh aspect of the present invention, there is provided a ceiling mounted ventilation fan with illumination according to any one of the first to fifth aspects, wherein on an inner surface of the main housing, a sound absorbing material is placed at least at a position facing an air inlet of the fan unit.

According to an eighth aspect of the present invention, there is provided a ceiling mounted ventilation fan with illumination according to any one of the first to fifth aspects, wherein the main housing further includes a third opening formed at a position separate from the second opening and communicating with the inside of the room, so that air introduced into the main housing through the second opening and the gap for air intake, together with air introduced into the main housing through the third opening is discharged into the duct through the first opening by the fan unit.

According to a ninth aspect of the present invention, there is provided a ceiling mounted ventilation fan with illumination comprising a main housing, and a fan unit and lighting equipment installed in the main housing, wherein the main housing includes a first opening connected to an air outlet of the fan unit, the first opening communicating with a duct, and a second opening formed in a lower part of the main housing, the main housing is installed in a ceiling in such a way that the indoor-side air inlet formed by an opening member provided at a ceiling opening and the second opening of the main housing are communicated with each other, the lighting equipment includes a lighting part, a lighting cover placed within the main housing so as to surround a periphery of the lighting part, the lighting part having a reflecting surface for reflecting light from the lighting part to lead the light to inside of a room through the second opening and the opening member, and a restriction member for restricting passage of air through between the periphery of the lighting part and the lighting cover, and a gap for air intake is formed between a lower end of the lighting cover and an edge of the opening member so that air introduced into the main housing through the opening member and the gap for air intake is discharged through the first opening into the duct by the fan unit.

According to a tenth aspect of the present invention, there is provided a ceiling mounted ventilation fan with illumination according to the ninth aspect, wherein the lighting equipment comprises an adjustment mechanism for adjusting a height position of the lighting cover relative to the ceiling opening, wherein the height position of the lighting cover is adjusted by use of the adjustment mechanism thereby adjusting size of the gap for air intake.

According to an eleventh aspect of the present invention, there is provided a ceiling mounted ventilation fan with illumination comprising a main housing, and a fan unit and lighting equipment installed in the main housing, wherein the main housing includes a first opening connected to an air outlet of the fan unit, the first opening communicating with a duct, and a second opening formed in a lower part of the main housing so as to communicate with inside of a room, the lighting equipment includes a lighting part, a lighting cover placed within the main housing so as to surround a periphery of the lighting part, the lighting cover having a reflecting surface for reflecting light from the lighting part to lead the light to the inside of the room through the second opening, and a restriction member for restricting passage of air through between the periphery of the lighting part and the lighting cover, the lighting cover is placed so as to extend through the second opening so that a lower end of the lighting cover is protruded from the second opening toward the inside of the room, and a gap for air intake is formed between the lower end of the lighting cover and an edge of the second opening so that air introduced into the main housing through the gap for air intake and the second opening is discharged through the first opening into the duct by the fan unit.

According to a twelfth aspect of the present invention, there is provided a ceiling mounted ventilation fan with illumination according to the eleventh aspect, wherein the lighting equipment has an adjustment mechanism for adjusting a height position of the lighting cover relative to the second opening of the main housing, wherein the height position of the lighting cover is adjusted by use of the adjustment mechanism thereby adjusting size of the gap for air intake.

Effects of Invention

According to the present invention, in the ceiling mounted ventilation fan with illumination, a restriction member for restricting passage of air through between a lighting cover and a periphery of a lighting part is provided, the lighting cover having a reflecting surface for reflecting light from the lighting part to lead the light to the inside of the room, and moreover a gap for air intake is formed between a lower end of the lighting cover and an edge of the indoor-side opening. Thus, air introduced into the main housing through the gap for air intake is discharged into the duct by the fan unit and moreover conduction of operation noises of the fan unit and the like to the indoor side with the noise directivity enhanced in the lighting cover can be suppressed by the restriction member. Accordingly, there can be provided a ceiling mounted ventilation fan with illumination capable of suppressing conduction of noises to the room inside.

DESCRIPTION OF EMBODIMENTS

Figure 1:
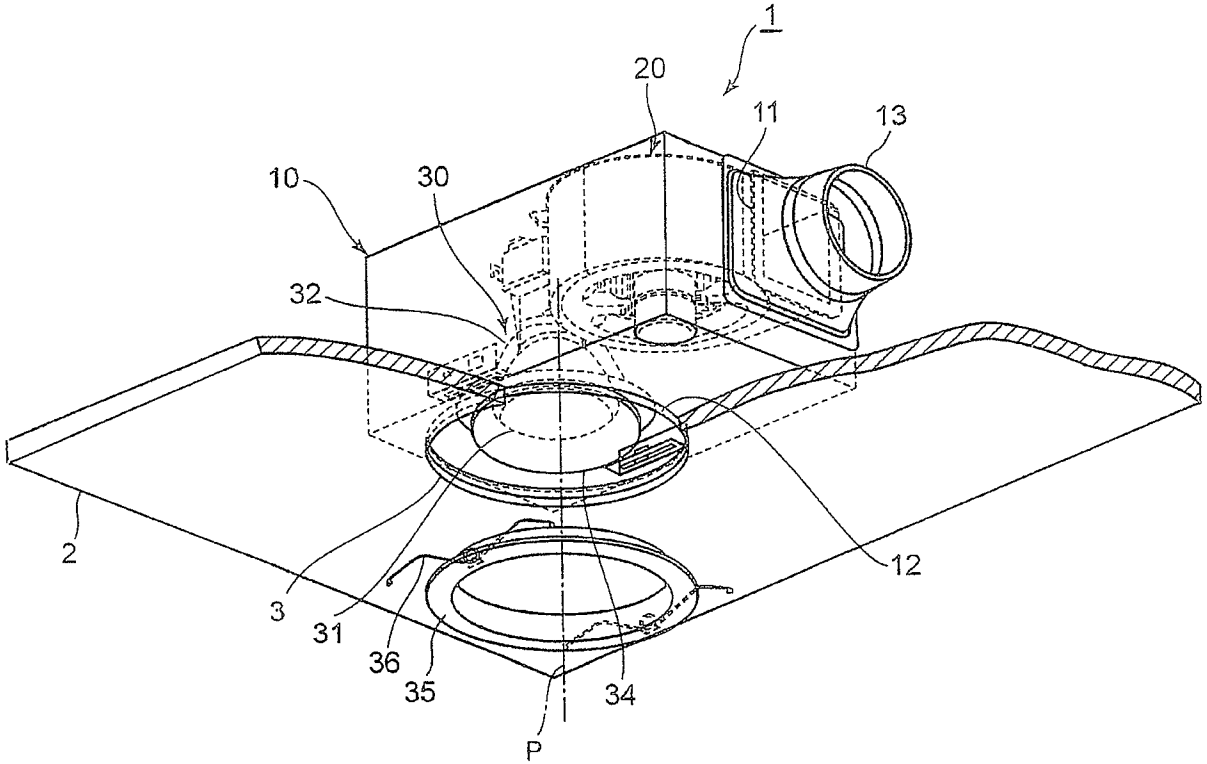
FIG. 1 is a perspective view of a ceiling mounted ventilation fan with illumination in accordance with Embodiment 1 of the invention.

Before the description of the present invention proceeds, it is to be noted that like parts are designated by like reference numerals throughout the accompanying drawings. Hereinbelow, embodiments of the present invention will be described in detail with reference to the accompanying drawings.

Embodiment 1

Figure 2:
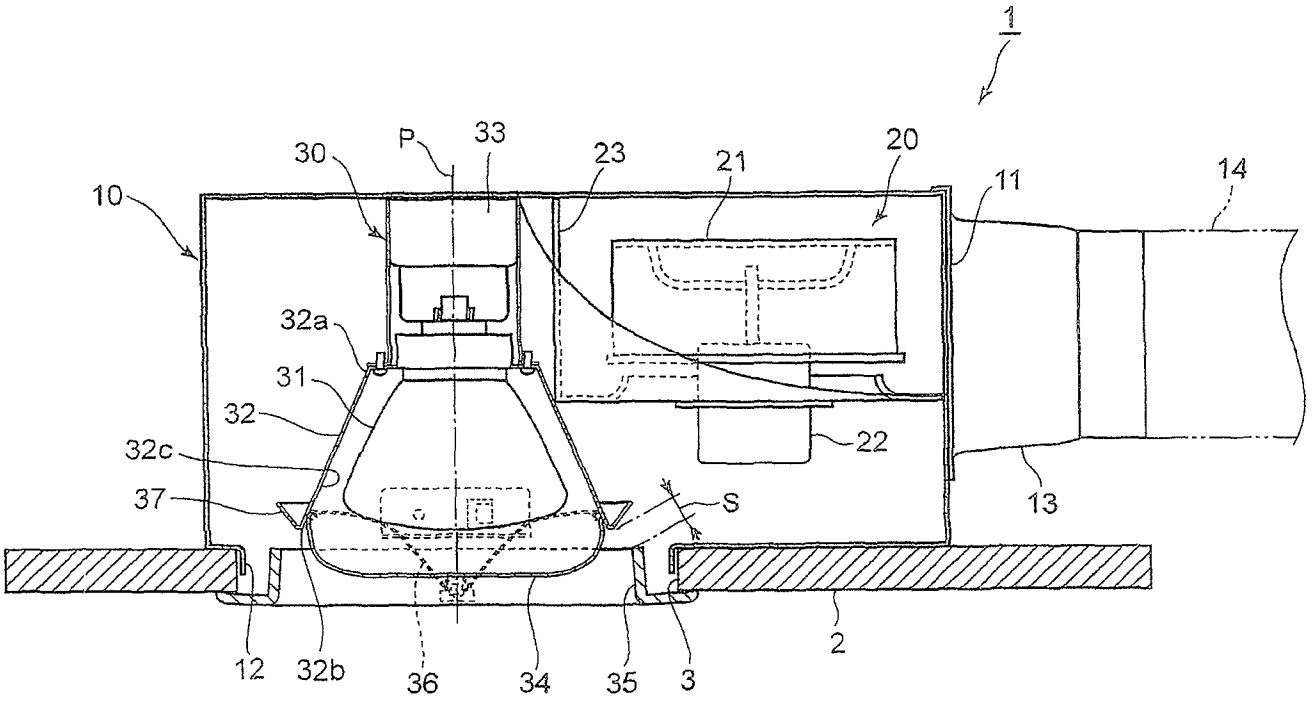
FIG. 2 is a sectional view of the ceiling mounted ventilation fan with illumination of Embodiment 1.

FIG. 1 shows a perspective view of a ceiling mounted ventilation fan 1 with illumination in accordance with Embodiment 1 of the invention. FIG. 2 shows a sectional view (partly sectional view) thereof.

As shown in FIGS. 1 and 2, the ceiling mounted ventilation fan 1 with illumination includes a main housing 10 that is generally shaped like a box, and a fan unit 20 and lighting equipment 30 that are placed in the main housing 10.

The main housing 10 has a first opening 11 connected to an air outlet of the fan unit 20 and a second opening 12 communicating with inside of a room through a ceiling opening 3 formed on the ceiling 2. The first opening 11 formed on a side part of the main housing 10 is connected to a duct connection part 13 so as to communicate with a duct 14 through the duct connection part 13. Although FIGS. 1 and 2 show an example in which the first opening 11 is formed at a side part of the main housing 10 while the second opening 12 is formed at a lower part, the case may also be such that the first opening 11 is formed at an upper part of the main housing 10.

The fan unit 20 has a fan 21, a motor 22 for rotating the fan 21, and a fan casing 23 placed so as to surround the fan 21. The fan unit 20 is fixed to a top inner wall of the main housing 10. An air inlet of the fan unit 20 is opened inside the main housing 10, and air inside the main housing 10 taken into the fan unit 20 through the air inlet is discharged through the air outlet, the first opening 11 and the duct connection part 13 into the duct 14. Although a centrifugal fan such as multiblade fan will be described as an example of the type of the fan unit 20, there may be employed other types of fans that are capable of achieving such a function of discharge.

The lighting equipment 30 includes a lamp (lighting part) 31, a lighting cover 32 (a cover for lighting) that surrounds the lamp 31, and a lamp mounting fixture 33 for detachably fixing the lamp 31 and the lighting cover 32 onto the inner wall of the main housing 10. The lamp 31 and the lighting cover 32 are placed on a central axis P so that center positions thereof substantially coincide with a center of the second opening 12 of the main housing 10 as seen looking in a vertical direction. In addition to a function of detachably fixing the lamp 31 and the lighting cover 32, the lamp mounting fixture 33 has a function of supplying the lamp 31 with electricity. As the lamp 31, a fluorescent lamp or an LED other than so-called electric bulbs may be used. The arrangement may also be another in which an electric heater is used instead of the lamp 31 and covered by the lighting cover 32. A relation of placement between the lamp 31, the lighting cover 32 and the second opening 12 of the main housing 10 is not limited to such a relation that those centers substantially coincide with one another as seen looking in the vertical direction. The relation of placement has only to be such that light from the lamp 31 is cast into the room through the second opening 12.

The lighting cover 32 is generally formed in shape of a circular truncated conical cylinder so that a diameter of a lower end 32*b* of the lighting cover 32 is greater than that of an upper end 32*a* thereof. The lighting cover 32 is formed so as to have a length (size in the vertical direction) that covers an overall surrounding side of a light emitting part of the lamp 31 provided inside the cover 32. Between the lighting cover 32 and the lamp 31 is secured such a clearance as prevents contact therebetween.

An inner circumferential surface of the lighting cover 32 forms a reflecting surface 32*c* that reflects the light from the lamp 31 toward the second opening 12 (i.e., downward). The lighting cover 32 having such a reflecting surface 32*c* allows the light from the lamp 31 to become direct light and reflected light and to efficiently irradiate the inside of the room.

The lighting equipment 30 includes a lid (lid member) 34 for sealing an opening of the lower end 32*b* of the lighting cover 32. The lid 34 is detachably attached to the lower end 32*b* of the lighting cover 32 so as not to be in contact with the lamp 31. The lid 34 is detached from the lighting cover 32 on occasion of replacement of the lamp 31 or the like.

A flange 35 (opening member) that is an annular member is mounted on the ceiling opening 3. The flange 35 serves as a dressing member that covers a lower periphery and an inner circumferential surface of the ceiling opening 3 so as to prevent the ceiling opening 3 from being directly seen from the inside of the room. The flange 35 is attached while biasing the lower periphery of the ceiling opening 3 upward through biasing members (such as wire-like springs) 36 that each have one end engaged with the main housing 10 and the other end engaged with the flange 35. When the flange 35 is released from the ceiling opening 3, the biasing members 36 prevent the flange 35 from falling down. FIG. 1 shows a state in which the flange 35 has been released from the ceiling opening 3.

As shown in FIG. 2, an annular gap S for air intake is provided between the lower end 32*b* of the lighting cover 32 and an edge of the second opening 12 of the main housing 10, more particularly, an inside edge of the flange 35. An introduction path for indoor air is formed so that the indoor air introduced through the ceiling opening 3 on which the flange 35 is placed is then guided through the annular gap S for air intake and the second opening 12 into the main housing 10.

An annular brim 37 is formed on the lower end 32*b* of the lighting cover 32, and the annular brim 37 is formed so as to protrude toward surroundings thereof.

Once the lamp 31 is turned on in the ceiling mounted ventilation fan 1 with illumination that has such a configuration, the light from the lamp 31 is introduced through the lid 34 and the ceiling opening 3 (opening of the flange 35) into the room and light from a circumferential surface of the side part of the lamp 31 is reflected downward by the reflecting surface 32*c* of the lighting cover 32 and is subsequently introduced through the lid 34 and the ceiling opening 3 into the room. Thus the ceiling mounted ventilation fan 1 with illumination functions as a downlight.

When the fan 21 is rotated by the motor 22 of the fan unit 20, the indoor air is introduced through the ceiling opening 3 and the annular gap S for air intake into the main housing 10. In the annular gap S for air intake, wind noises produced by the lower end 32*b* of the lighting cover 32 are reduced by the annular brim 37 formed on the lower end 32*b* of the lighting cover 32. The air introduced into the main housing 10 is taken into the fan casing 23 and discharged from the fan unit 20 through the first opening 11 and the duct connection part 13 into the duct 14. Thus the ceiling mounted ventilation fan 1 with illumination functions as a ventilation fan.

In this case, the lighting cover 32 that is placed so as to surround the lamp 31 has the cylindrical lower end 32*b* sealed with the lid 34. Thus passage of air through between the lamp 31 and the lighting cover 32 is restricted. This reduces propagation into the room of air blow noises caused by operation of the fan unit 20 placed in the main housing 10 and the operation noises from the motor 22 with enhancement of directivity thereof that is caused by the lighting cover 32 which is generally in shape of a circular truncated conical cylinder and which functions as a megaphone. In particular, the lighting cover 32 is often generally shaped like a circular truncated conical cylinder because the cover 32 is required to have the reflecting surface 32*c* for the light from the lamp 31. There is a high possibility that the lighting cover 32 with such a shape functions as a so-called megaphone. The provision for the lighting cover 32 of the lid 34 that restricts the passage of air effectively reduces the propagation into the room of the noises produced in the main housing 10 with the enhancement of directivity thereof.

Figure 3A:
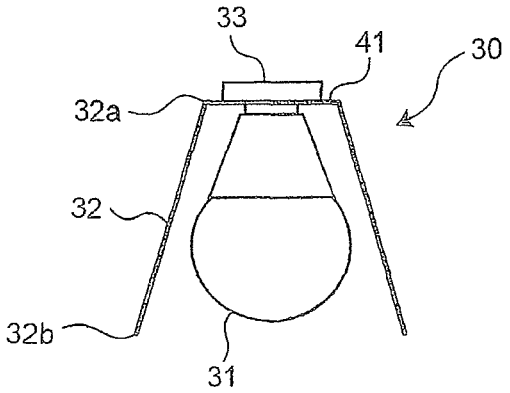
FIG. 3A is a schematic view showing a placement example of a restriction member in the lighting cover.
Figure 3B:
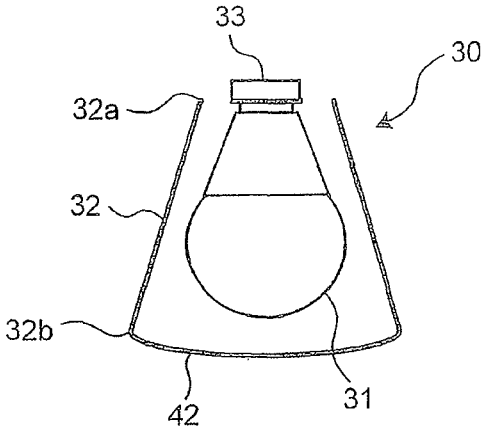
FIG. 3B is a schematic view showing a placement example of a restriction member in the lighting cover.
Figure 3C:
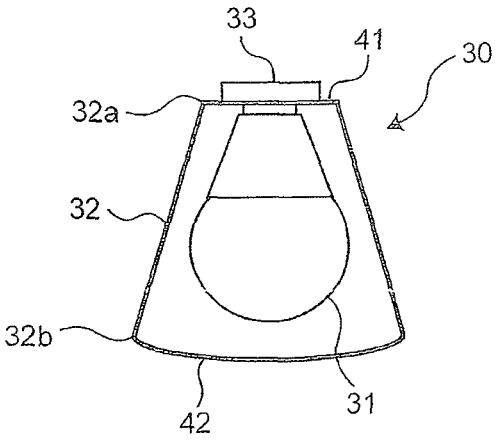
FIG. 3C is a schematic view showing a placement example of a restriction member in the lighting cover.

Although the example provided with the lid 34 for sealing the lower end 32*b* of the lighting cover 32 has been described above, the invention is not limited only to such a configuration. Provision of members (restriction members) capable of restricting the passage of air through between the lighting cover 32 and the lamp 31 ensures the same effect as that of the provision of the lid 34. For instance, as shown in the schematic view of the lighting equipment 30 shown in FIG. 3A, a restriction member 41 that seals the upper end 32*a* may be provided in the lighting cover 32 with the lower end 32*b* thereof opened. Alternatively, as shown in FIG. 3B, a restriction member 42 that seals the lower end 32*b* of the lighting cover 32 may be provided with the upper end 32*a* thereof opened. Further as shown in FIG. 3C, there may be provided both the restriction member 41 that seals the upper end 32*a* of the lighting cover 32 and the restriction member 42 that seals the lower end 32*b*.

Such restriction members have only to have a configuration by which the function of restricting the passage of air through between the lighting cover 32 and the lamp 31 is achieved. The configuration is not limited only to a configuration that completely shuts off the passage of air and the passage of air has only to be restricted in general. The passage of air has only to be restricted in general, even if openings required for the attachment of the lamp 31 and power supply are provided in the restriction members, for instance.

The lighting cover 32 may be shaped like a generally polygonal truncated prismoidal cylinder or a hemisphere, other than the generally circular truncated conical cylinder. The restriction members may integrally be formed with the lighting cover 32.

The gap S for air intake has only to be formed around the lower end 32*b* of the lighting cover 32 and has only to be formed between the lower end 32*b* of the lighting cover 32 and the flange 35, or between the lower end 32*b* and the second opening 12, or between the lower end 32*b* and the ceiling opening 3.

Sizes (area) of the gap S for air intake have only to be determined in design in consideration of specifications (air flow, static pressure and the like) of the fan unit 20, sizes of the lamp 31 and the lighting cover 32, a size of the ceiling opening 3, and the like.

Embodiment 2

Figure 4:
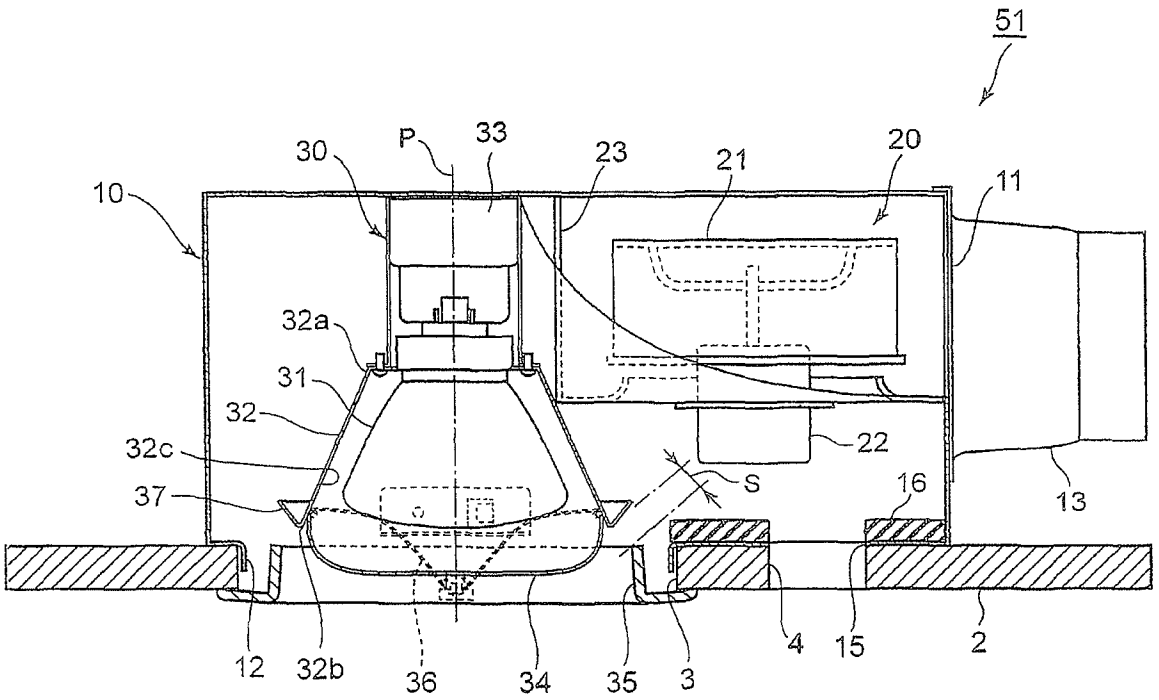
FIG. 4 is a sectional view of a ceiling mounted ventilation fan with illumination in accordance with Embodiment 2 of the invention.

The present invention is not limited to the above-described embodiment, and may be carried out in other various embodiments. As an example, FIG. 4 shows a configuration of a ceiling mounted ventilation fan 51 with illumination in accordance with Embodiment 2 of the invention. In the configuration of this ceiling mounted ventilation fan 51 with illumination of Embodiment 2 shown in FIG. 4, an opening 4 is additionally provided on the ceiling 2 independently of the ceiling opening 3 while a third opening 15 is provided in the main housing 10, so that indoor air can be introduced also through the opening 4 and the third opening 15. With the configuration like this, when the required size (area) of the gap S for air intake cannot be ensured, a shortage air-intake area can be ensured.

Also, as shown in FIG. 4, a sound absorbing material 16 is placed on an inner wall surface of the main housing 10 facing the air inlet of the fan unit 20. With the sound absorbing material 16 placed as shown above, sounds produced by the fan unit 20 can be partly absorbed and reduced by the sound absorbing material 16. The sound absorbing material may also be placed over the entire inner wall surface of the main housing 10. Usable as such a sound absorbing material are those materials having a sound absorbing effect or sound-reflection suppressing effect such as porous materials and fiber materials; for example, felt material or the like is used.

Embodiment 3

Figure 5:
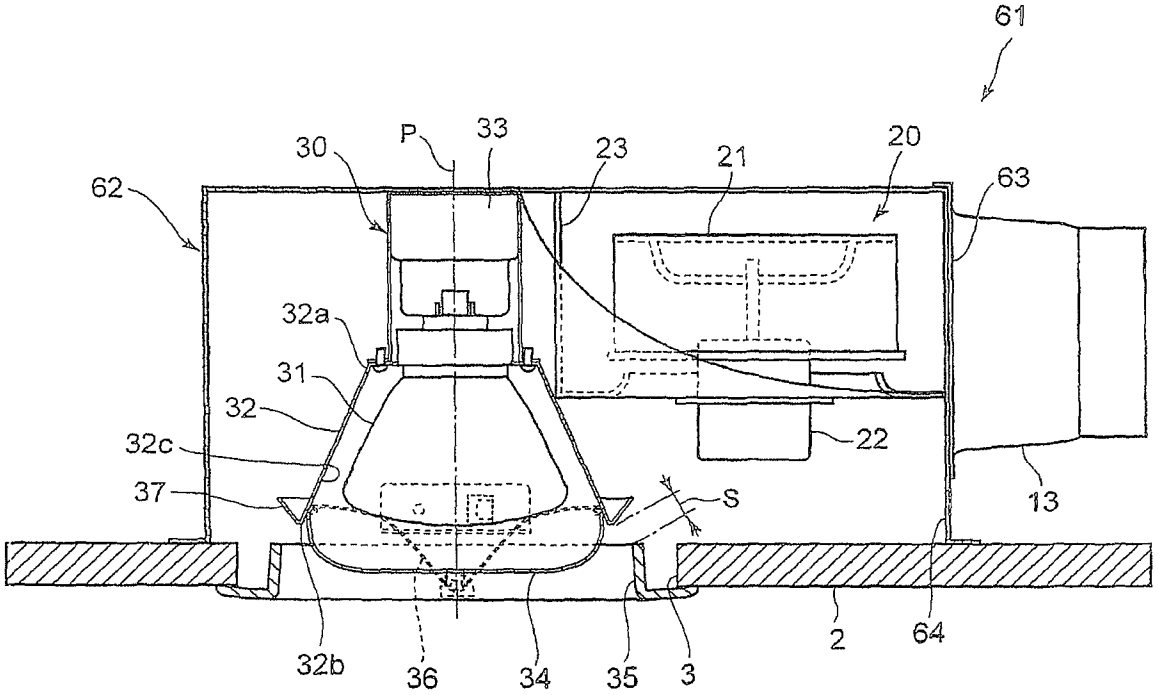
FIG. 5 is a sectional view of a ceiling mounted ventilation fan with illumination in accordance with Embodiment 3 of the invention.

FIG. 5 shows a configuration of a ceiling mounted ventilation fan 61 with illumination in accordance with Embodiment 3 of the invention. As in the ceiling mounted ventilation fan 61 with illumination of Embodiment 3 shown in FIG. 5, a configuration in which a whole lower part of a main housing 62 is opened is also adoptable. A first opening 63 to be connected the duct connection part 13 is formed in a side part of the main housing 62, and a whole lower part of the main housing 62 is formed as a second opening 64. With such a configuration, since the air inlet from the indoor side is defined by the flange 35 attached to the ceiling opening 3, the substantially same effect as that of the ceiling mounted ventilation fan 1 with illumination of Embodiment 1 shown in FIGS. 1 and 2 can be obtained.

Embodiment 4

Figure 6:
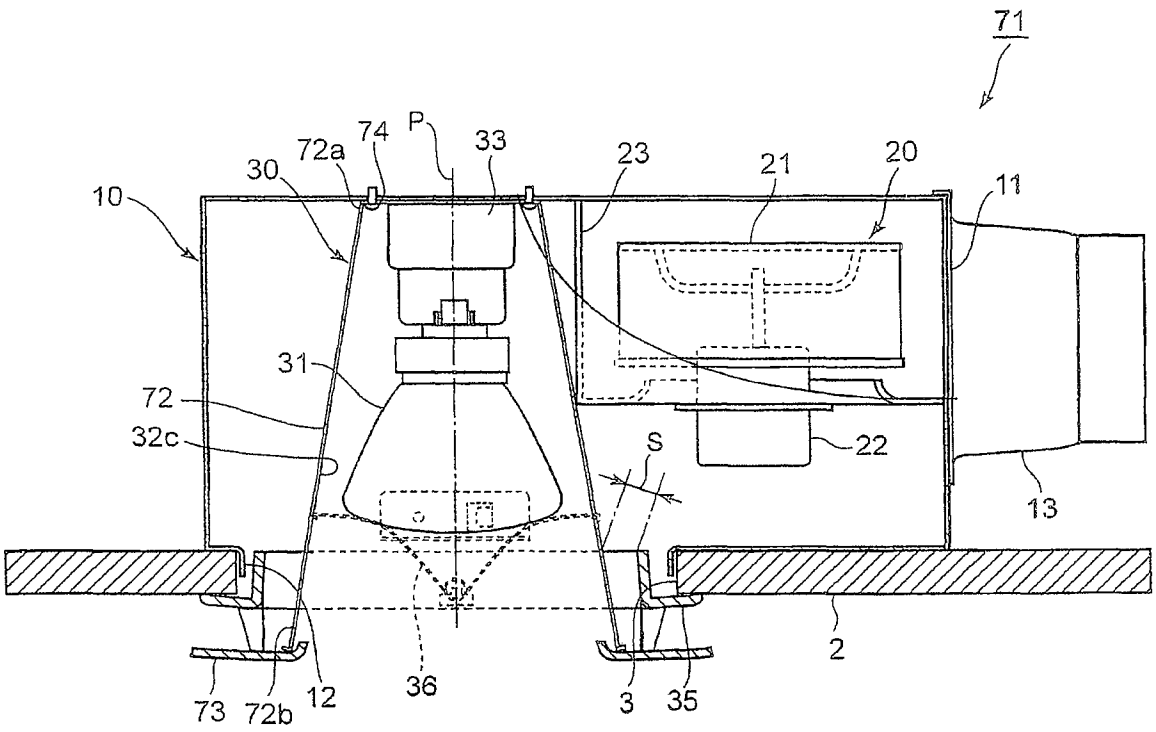
FIG. 6 is a sectional view of a ceiling mounted ventilation fan with illumination in accordance with Embodiment 4 of the invention.
Figure 7:
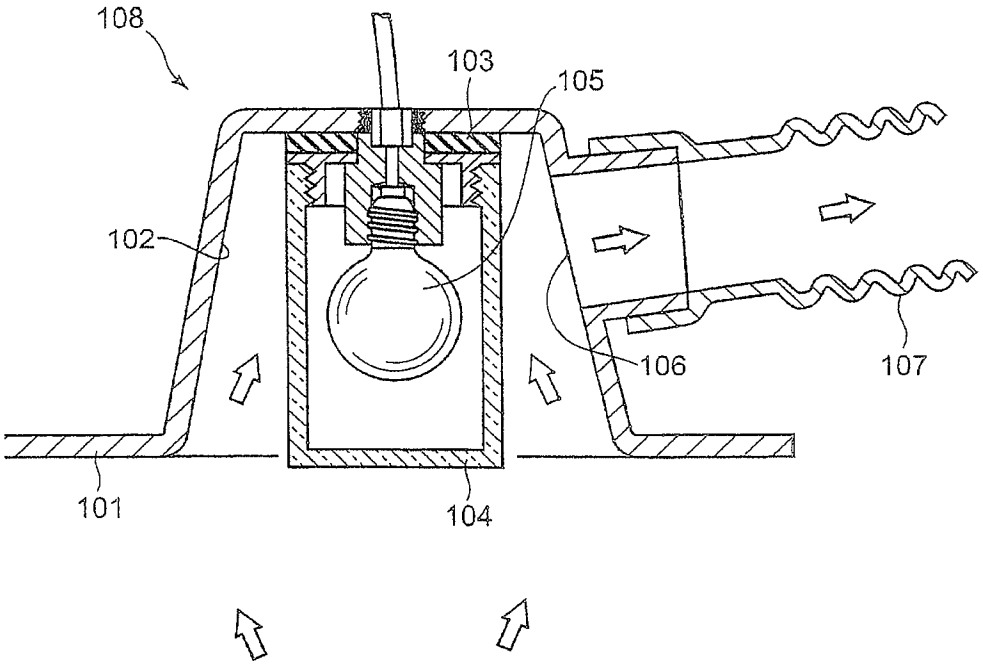
FIG. 7 is a sectional view showing a conventional ceiling mounted ventilation structure with illumination.

FIG. 6 shows a configuration of a ceiling mounted ventilation fan 71 with illumination in accordance with Embodiment 4 of the invention. The ceiling mounted ventilation fan 71 with illumination of Embodiment 4 shown in FIG. 6 has a configuration that differs from the foregoing individual embodiments in that a lower end 72*b* of a lighting cover 72 is placed so as to protrude toward the indoor side through the second opening 12 of the main housing 10, the ceiling opening 3 and the flange 35.

In such a configuration, an annular gap S for air intake is formed between the lower end 72*b* of the lighting cover 72 placed in protrusion toward the indoor side (i.e., placed lower than the ceiling 2) and the inner edge of the flange 35 (or second opening 12). Indoor air is introduced into the main housing 10 through this gap S for air intake and discharged into the duct 14 by the fan unit 20. On the lower end 72*b* of the lighting cover 72, an annular brim 73 is formed so as to protrude toward surroundings thereof. The brim 73 like this has a dressing effect that the gap S for air intake is made less easy to view from the indoor side.

The lighting cover 72 in a generally circular truncated conical cylinder shape is formed so that its upper end 72*a* is sealed by a sealing member 74. Therefore, passage of air through between the lamp 31 and the lighting cover 72 is restricted, so that conduction of noises produced in the main housing 10 toward the indoor side with their directivity enhanced is suppressed.

Embodiment 5

Figure 8:
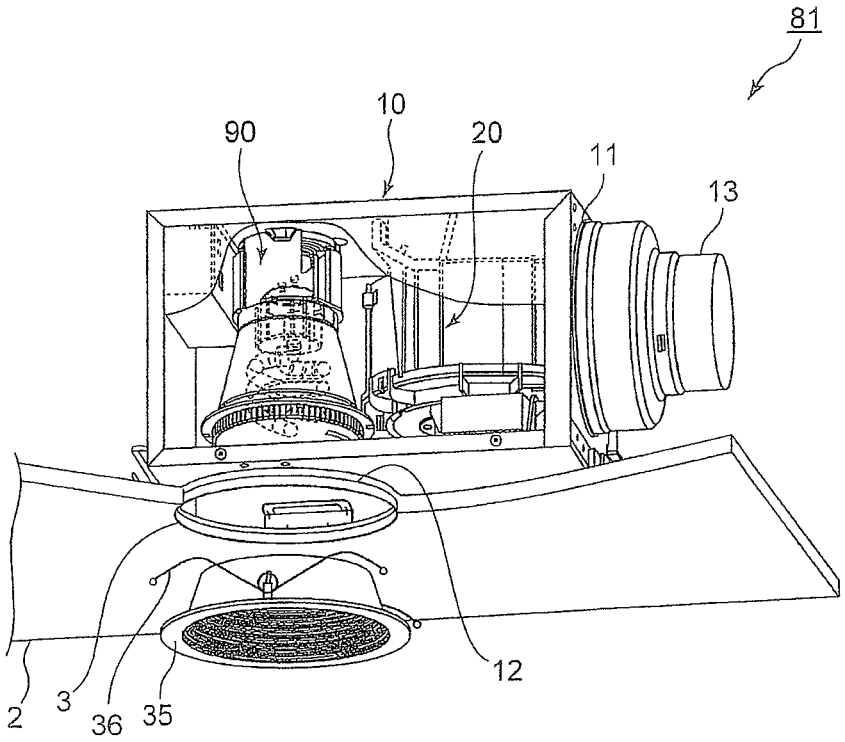
FIG. 8 is a perspective view of a ceiling mounted ventilation fan with illumination of Embodiment 4 of the invention.
Figure 9:
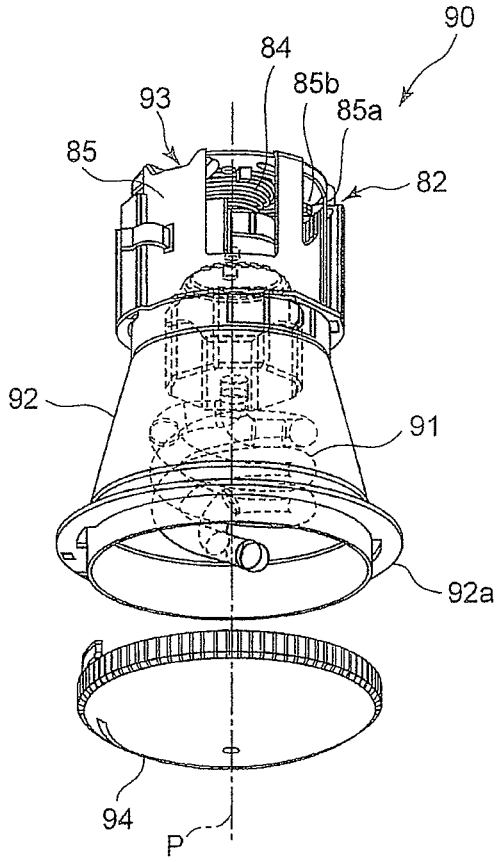
FIG. 9 is a perspective view of lighting equipment.

FIG. 8 shows a configuration of a ceiling mounted ventilation fan 81 with illumination in accordance with Embodiment 5 of the invention. The ceiling mounted ventilation fan 81 with illumination of Embodiment 5 shown in FIG. 8 differs from the ceiling mounted ventilation fan 1 with illumination of Embodiment 1 in terms of the configuration of lighting equipment 90, with the rest of the configuration being substantially similar thereto. The following description will be given primarily about the configuration of the lighting equipment 90. FIG. 9 shows a perspective view of the lighting equipment 90, and FIG. 10 shows an exploded view thereof.

Figure 10:
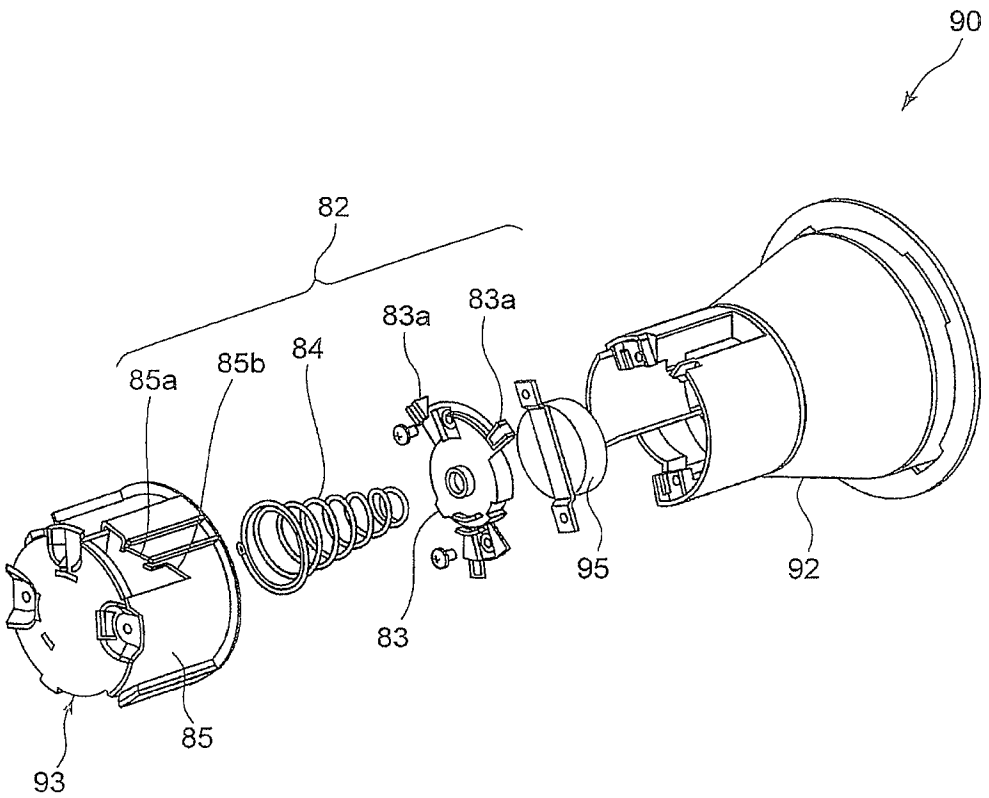
FIG. 10 is an exploded view of the lighting equipment.

As shown in FIGS. 8 to 10, the lighting equipment 90 includes a lamp 91, which is a vortex type fluorescent lamp, a lighting cover 92 for surrounding the lamp 91, a lamp mounting fixture 93, and a lid 94. Further, the lamp mounting fixture 93 includes an adjustment mechanism 82 for variably adjusting height positions of the lamp 91 and the lighting cover 92.

As shown in FIGS. 9 and 10, the adjustment mechanism 82 chiefly includes a generally disc-shaped engaging member 83 attached at an upper end 92*a* of the lighting cover 92, and a spring member 84 placed within a casing 85 of the lamp mounting fixture 93 to normally bias the engaging member 83 downward. Also, the lamp 91 is detachably fitted to a lamp socket 95, and the engaging member 83 is fixed via the lamp socket 95 to the lighting cover 92 by screwing or the like. Accordingly, the lamp 91 and the lighting cover 92 are made integrally rotatable with the engaging member 83 about a central axis P relative to the casing 85 of the lamp mounting fixture 93.

In the cylindrical circumferential surface of the casing 85 of the lamp mounting fixture 93, two kinds of engaging holes of mutually different height positions, i.e. a first engaging hole 85*a* and a second engaging hole 85*b* positioned lower in height than the first engaging hole 85*a*, are formed. Meanwhile, an engaging claw 83*a* to be engaged selectively with either one of the first engaging hole 85*a* and the second engaging hole 85*b* in the casing 85 of the lamp mounting fixture 93 is formed on the circumferential edge of the generally disc-shaped engaging member 83. As the engaging claw 83*a* is engaged selectively with either one of the first engaging hole 85*a* and the second engaging hole 85*b* by rotating the engaging member 83 together with the lamp 91 and the lighting cover 92 about the central axis P, the height positions of the lamp 91 and the lighting cover 92 can be changed. Also, since the engaging member 83 is normally biased downward by the spring member 84, an engagement state between the first engaging hole 85*a* or the second engaging hole 85*b* and the engaging claw 83*a* is maintained, so that the height positions of the lamp 91 and the lighting cover 92 are retained.

Figure 11:
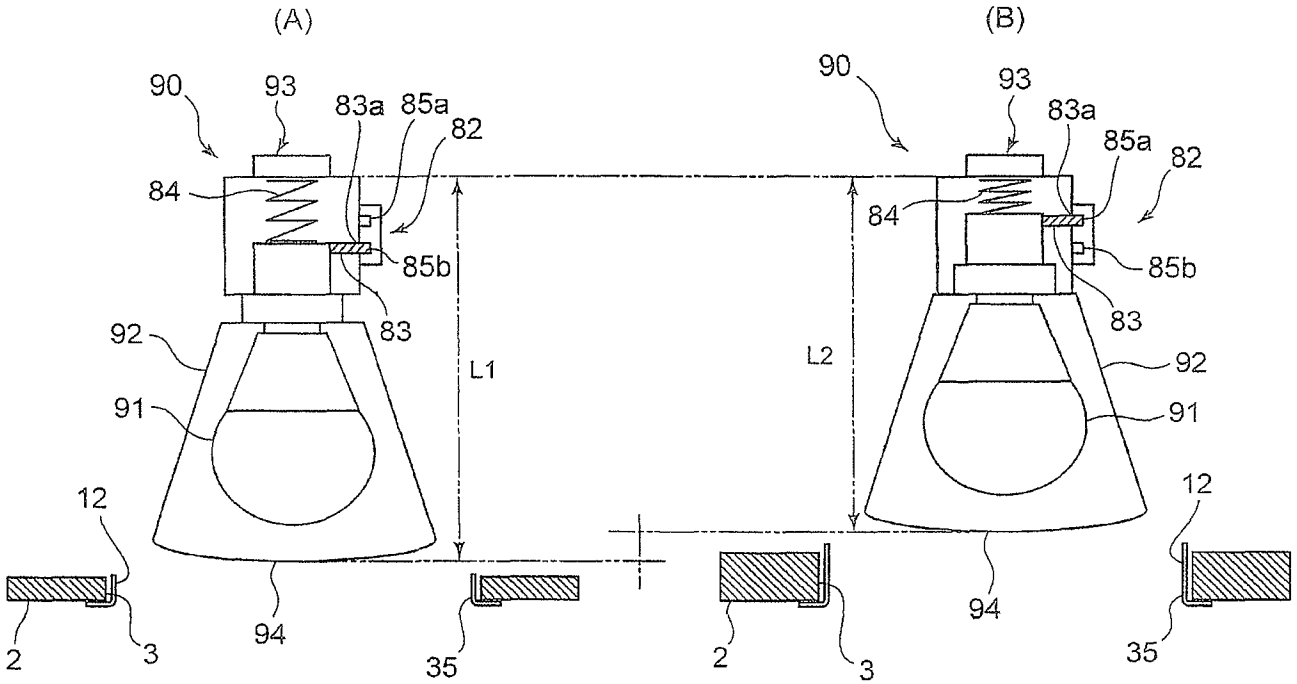
FIG. 11 is an explanatory view of height adjustment of the lighting equipment.

Now, the adjustment of height positions of the lamp 91 and the lighting cover 92 by the adjustment mechanism 82 as shown above will be explained below with reference to the schematic view shown in FIG. 11.

Referring first to FIG. 11(A), in the lighting equipment 90, the engaging claw 83*a* is in a state of being engaged with the second engaging hole 85*b*. In this state, the lamp 91 and the lighting cover 92 are positioned at lower height positions by biasing force of the spring member 84, where the lighting equipment 90 has a length of L1.

Referring to FIG. 11(B), on the other hand, in the lighting equipment 90, the engaging claw 83*a* is in a state of being engaged with the first engaging hole 85*a*. In this state, the lamp 91 and the lighting cover 92 are positioned at upper height positions, where the lighting equipment 90 has a length of L2 (L2<L1).

With the lighting equipment 90 provided with the adjustment mechanism 82 as shown above, in a case where the ceiling 2 differs in thickness as shown in FIGS. 11(A) and (B) as an example, it becomes possible to adjust height positions of the lamp 91 and the lighting cover 92 (i.e., height position of the lower end 92*a* of the lighting cover 92) relative to the ceiling opening 3 or the second opening 12 so as to adjust the gap S for air intake to a proper size.

Even in cases of equal thickness of the ceiling 2, it is also possible to adjust the quantity of air passing through the gap S for air intake by adjusting the height positions of the lamp 91 and the lighting cover 92 by the adjustment mechanism 82.

In this Embodiment 5, since the lighting equipment 90 is separated from the flange 35, it becomes possible to adjust the height positions of the lamp 91 and the lighting cover 92 relative to the flange 35. Moving the lamp 91 and the lighting cover 92 upward by the adjustment mechanism 82 allows the gap S for air intake to be set larger.

This Embodiment 5 has been described on an example in which a disc-shaped rotatable engaging member 83 is used as the adjustment mechanism 82. However, various mechanisms capable of height adjustment are also adoptable including a mechanism in which a bolt fixed to the main housing 10 in a state of vertical placement is set to support the lighting equipment 90, and in which a nut screwed with the bolt is turned so that the support height of the lighting equipment 90 is adjusted.

Also, this Embodiment 5 has been described on a configuration in which the lighting cover 92 and the lid 94 can be positioned upper than the upper end of the flange 35 by the adjustment mechanism 82. However, a similar configuration may be adopted also in the foregoing Embodiments 1 to 3.

Working Example 1

With the ceiling mounted ventilation fan 1 with illumination of Embodiment 1, noise measurement during operation was performed with respect to two types of configurations, one configuration (Working Example) in which passage of air through between the lighting cover 32 and the lamp 31 is restricted while indoor air is introduced into the main housing 10 through the gap S for air intake, and the other configuration (Comparative Example) in which the lighting cover is made up so as to eliminate the presence of any gap S for air intake while indoor air is introduced through between the lighting cover and the lamp. It is noted that a multiblade fan unit having an air flow rate of 80 CFM was used as the fan unit.

In a measurement room shielded from external sounds, noise measurement was performed at three points in total, specifically, at left-and-right two points laterally and horizontally 1 m distant from the ceiling mounted ventilation fan with illumination and at one lower point downwardly 1 m distant therefrom. It is noted that background noise was 15.1 dB.

The ceiling mounted ventilation fan with illumination of Comparative Example showed results of 36.4 dB at the left measuring point, 36.8 dB at the right measuring point, and 39.8 dB at the lower measuring point, while the ceiling mounted ventilation fan with illumination of Working Example showed results of 35.0 dB at the left measuring point, 35.3 dB at the right measuring point, and 38.6 dB at the lower measuring point.

From these noise measurement results, it can be understood that the ceiling mounted ventilation fan with illumination of Working Example has a higher noise suppression effect compared with Comparative Example. It can be considered that Working Example, in which the gap S for air intake is provided, is enabled to achieve noise reduction by virtue of its capability of reducing pressure loss to more extent as compared with Comparative Example as well as its suppression of the possibility that the lighting cover serves as a megaphone to cause enhancement of noise directivity.

It is to be noted that, by properly combining the arbitrary embodiments of the aforementioned various embodiments, the effects possessed by them can be produced.

Although the present invention has been fully described in connection with the preferred embodiments thereof with reference to the accompanying drawings, it is to be noted that various changes and modifications are apparent to those skilled in the art. Such changes and modifications are to be understood as included within the scope of the present invention as defined by the appended claims unless they depart therefrom.

REFERENCE SIGNS LIST

1 ceiling mounted ventilation fan with illumination
2 ceiling
3 ceiling opening
10 main housing
11 first opening
12 second opening
13 duct connection part
14 duct
20 fan unit
21 fan
22 motor
23 fan casing
30 lighting equipment
31 lamp
32 lighting cover
**32*a*** upper end
**32*b*** lower end
**32*c*** reflecting surface
33 lamp mounting fixture
34 lid
35 flange
36 biasing member
S gap for air intake

What is claimed is:

1. A ceiling mounted ventilation fan with illumination comprising a fan unit, a main housing, and lighting equipment installed in the main housing, wherein the main housing includes a first opening in communication with the fan unit and a duct, and a second opening provided in a lower part of the main housing so as to communicate with an interior of a room, the lighting equipment includes a lighting part, a lighting cover fixed to the main housing and provided in the main housing so as to surround a periphery of the lighting part, the lighting cover having a reflecting surface for reflecting light from the lighting part to transmit the light into the room through the second opening, and a restrictor that restricts passage of air between the periphery of the lighting part and the lighting cover, and a gap for air intake is provided between a lower end of the lighting cover and an edge of the second opening so that air is introduced into the main housing through the second opening and the gap for air intake, and the introduced air is discharged through the first opening into the duct by the fan unit, the edge of the second opening being located below the lower end of the lighting cover.

2. The ceiling mounted ventilation fan with illumination according to claim 1, wherein the lighting cover comprises a generally circular truncated conical cylinder shape or a generally polygonal truncated prismoidal cylinder shape such that an opening of a lower end of the lightning cover is larger than an opening of an upper end of the lightning cover, and a lid member that substantially seals the opening of the lower end comprises the restrictor.

3. The ceiling mounted ventilation fan with illumination according to claim 2, wherein the lid member is detachably provided at the lower end of the lighting cover.

4. The ceiling mounted ventilation fan with illumination according to claim 1, wherein, on an inner surface of the main housing, a sound absorbing material is provided at least at a position facing an air inlet of the fan unit.

5. The ceiling mounted ventilation fan with illumination according to claim 1, wherein the main housing further includes a third opening provided at a position spaced from the second opening and communicating with the interior of the room, so that air introduced into the main housing through the second opening and the gap for air intake, together with air introduced into the main housing through the third opening, is discharged into the duct through the first opening by the fan unit.

6. The ceiling mounted ventilation fan with illumination according to claim 1, wherein the lighting cover is spaced from the edge of the second opening of the main housing.

7. The ceiling mounted ventilation fan with illumination according to claim 1, the restrictor being configured to engage an interior surface of the lighting cover.

8. The ceiling mounted ventilation fan with illumination according to claim 1, the restrictor being attachable to and detachable from the lighting cover.

9. A ceiling mounted ventilation fan with illumination comprising a fan unit, a main housing, and lighting equipment installed in the main housing, wherein the main housing includes a first opening in communication with the fan unit and a duct, and a second opening provided in a lower part of the main housing, the main housing is configured to be installed in a ceiling such that an indoor-side air inlet provided by an opening member provided at a ceiling opening and the second opening of the main housing are in communication with each other, the lighting equipment includes a lighting part, a lighting cover fixed to the main housing and provided in the main housing so as to surround a periphery of the lighting part, the lighting part having a reflecting surface for reflecting light from the lighting part to transmit the light to an interior of a room through the second opening and the indoor-side air inlet, and a restrictor that restricts passage of air between the periphery of the lighting part and the lighting cover, and a gap for air intake is provided between a lower end of the lighting cover and an edge of the opening member so that air is introduced into the main housing through the indoor-side air inlet and the gap for air intake, and the introduced air is discharged through the first opening into the duct by the fan unit, the edge of the opening member being located below the lower end of the lighting cover.

10. The ceiling mounted ventilation fan with illumination according to claim 9, wherein the lighting cover is spaced from the edge of the opening member.

11. The ceiling mounted ventilation fan with illumination according to claim 9, the restrictor being configured to engage an interior surface of the lighting cover.

12. The ceiling mounted ventilation and with illumination according to claim 9, the restrictor being the attachable to and detachable from the lighting cover.

13. The ceiling mounted ventilation fan according to claim 9, said fan unit comprising a fan and a fan housing, said lighting part comprising a lamp.

14. A ceiling mounted ventilation fan with illumination comprising a fan housing, a main housing, and lighting equipment installed in the main housing, wherein the main housing includes a first opening in communication with the fan housing and a duct, and a second opening provided in a lower part of the main housing so as to communicate with an interior of a room, the lighting equipment includes a lamp, a lighting cover fixed to the main housing and provided in the main housing so as to surround a periphery of the lamp, the lighting cover having a reflecting surface for reflecting light from the lamp to transmit the light into the room through the second opening, and a restrictor that restricts passage of air between the periphery of the lamp and the lighting cover, and a gap for air intake is provided between a lower end of the lighting cover and an edge of the second opening so that air is introduced into the main housing through the second opening and the gap for air intake, and the introduced air is discharged through the first opening into the duct by the fan housing, the edge of the second opening being located below the lower end of the lighting cover.

15. The ceiling mounted ventilation fan with illumination according to claim 14, wherein the lighting cover comprises a generally circular truncated conical cylinder shape or a generally polygonal truncated prismoidal cylinder shape such that an opening of a lower end of the lightning cover is larger than an opening of an upper end of the lightning cover, and a lid member that substantially seals the opening of the lower end comprises the restrictor.

16. The ceiling mounted ventilation fan with illumination according to claim 15, wherein the lid member is detachably provided at the lower end of the lighting cover.

17. The ceiling mounted ventilation fan with illumination according to claim 14, wherein, on an inner surface of the main housing, a sound absorbing material is provided at least at a position facing an air inlet of the fan housing.

18. The ceiling mounted ventilation fan with illumination according to claim 14, wherein the main housing further includes a third opening provided at a position spaced from the second opening and communicating with the interior of the room, so that air introduced into the main housing through the second opening and the gap for air intake, together with air introduced into the main housing through the third opening, is discharged into the duct through the first opening by the fan housing.

19. The ceiling mounted ventilation fan with illumination according to claim 14, wherein the lighting cover is spaced from the edge of the second opening of the main housing.

* * * * *